US008096053B2

(12) United States Patent
Wong

(10) Patent No.: US 8,096,053 B2
(45) Date of Patent: Jan. 17, 2012

(54) NAIL CLIPPER

(76) Inventor: Wai Yip Wong, N.T. (HK)

( * ) Notice: Subject to any disclaimer, the term of this patent is extended or adjusted under 35 U.S.C. 154(b) by 472 days.

(21) Appl. No.: 12/277,307

(22) Filed: Nov. 25, 2008

(65) Prior Publication Data

US 2010/0050438 A1 Mar. 4, 2010

(30) Foreign Application Priority Data

Sep. 2, 2008 (CN) ..... 2008 10 119289

(51) Int. Cl.
*A45D 29/02* (2006.01)

(52) U.S. Cl. ..... 30/28; 30/125; 30/255

(58) Field of Classification Search ..... 30/26–29, 30/47, 125, 252–262; 132/75.4, 75.5
See application file for complete search history.

(56) References Cited

U.S. PATENT DOCUMENTS

| | | | | | |
|---|---|---|---|---|---|
| 31,032 | A | * | 1/1861 | Reist | 30/255 |
| 767,423 | A | * | 8/1904 | Nicholls | 30/142 |
| 803,796 | A | * | 11/1905 | Streight | 30/233 |
| 827,756 | A | * | 8/1906 | Seitz | 81/3.41 |
| 2,655,722 | A | * | 10/1953 | Klenk | 30/252 |
| 2,753,626 | A | * | 7/1956 | Bowers | 30/28 |
| 3,943,948 | A | * | 3/1976 | Sartore | 132/73 |
| 4,599,793 | A | * | 7/1986 | Iten | 30/47 |
| 5,711,075 | A | * | 1/1998 | Wolf | 30/28 |

* cited by examiner

*Primary Examiner* — Edward Landrum

(57) ABSTRACT

The present invention is a nail clipper. It has a slender body formed by an upper press lever and a lower press lever which are movably engaged, an upper cover and a lower cover which are respectively fitted onto the outer surfaces of the upper press lever and the lower press lever to form a slender etui, a lower blade which is movably pivotally engaged with one end of the upper press lever by means of a first pivotal axle, and an upper blade which is movably pivotally engaged with one end of the lower press lever by means of a second pivotal axle.

9 Claims, 4 Drawing Sheets

NAIL CLIPPER

BACKGROUND OF THE INVENTION

The present invention relates to a nail clipper and more particularly pertains to a nail clipper capable of being folded into a portable body in the shape of an etui, and belongs in the field of manicuring and pedicuring implements.

Most nail clippers available on the market have open cutting edges when they are stored, thereby not only easily cutting clothing articles or handbags, but also possibly scratching users' bodies. It is therefore very dangerous. Besides, cutting edges will also turn blunt through constant grinding against outside objects. Dirt is also easily accumulated in the gaps between the cutting edges. The lifetime of such a nail clipper is thus shortened. As the cutting edges of the nail clipper are open, its thickness is increased, and an irregular shape is exhibited. It is inconvenient to be stored, and it is also difficult to combine it with other tools to form a multipurpose tool. The scope of applications is therefore restricted.

For the sake of safety, some nail clippers have a casing each and the user places the nail clipper inside the casing for storage after use. Although this can prevent the cutting edges of the nail clipper from cutting the clothing articles or the bodies when it is stored and can protect the cutting edges, the casing is easily lost and the user needs to open the casing to take out the nail clipper before use and then to adjust the press lever of the nail clipper for use and it is therefore inconvenient.

Nail clippers capable of being folded into thin pieces after use are also available on the market. The cutting edges of such a nail clipper come into abutting contact when the nail clipper is stored, and it is safe and reliable, and the cutting edges are also protected. While the cutting edges come into abutting contact, nevertheless the left and right ends thereof are generally projecting corners and do not form a smooth surface, and so there are still the risks of scratching users' bodies. Further, gaps also exist between the cutting edges and they easily hold dirt, thereby affecting hygiene.

To conceal the cutting edges completely, some nail clippers have a sleeve each and the fastener corresponds to the body of the nail clipper in size. The sleeve is connected to the nail clipper pivotally. While in use the sleeve is pulled out along the axis to the end of the nail clipper and then the press lever is pulled up and turned over for use. After use, the press lever is turned over reversely to be laid horizontally on the main body of the nail clipper, and then the sleeve is pushed back along the axis to the main body of the nail clipper to store the nail clipper. Although this proposal can resolve the problem of having the cutting edges exposed when the nail clipper is stored, the sleeve has to be produced with additional materials, thereby increasing the production costs.

There are nail clippers on the market each of which is capable of being folded into an etui after use for storage by means of a protruding fastener and a receiving fastener. However, as the protruding fastener abrades against the receiving fastener over a long period of time, the protruding fastener is easily worn out and broken and the nail clipper fails to attain the effects of being convenient and durable.

BRIEF SUMMARY OF THE INVENTION

In view of the aforesaid disadvantages, the object of the present invention is to provide a nail clipper which has the advantages of being safe and reliable, small in size, convenient for storage, and capable of reducing the production costs.

To attain this, the present invention adopts the following technical proposals:

A nail clipper comprising a slender body formed by an upper press lever and a lower press lever which are movably engaged, a lower blade which is movably pivotally engaged with one end of the upper press lever by means of a first pivotal axle, and an upper blade which is movably pivotally engaged with one end of the lower press lever by means of a second pivotal axle; the widths of the lower blade and the upper blade are slightly lesser than the widths of the upper press lever and the lower press lever, the lengths thereof are lesser than the lengths of the upper press lever and the lower press lever; the slender body has a cavity for receiving the lower blade and the upper blade; either one of the lower blade and the upper blade is of lesser width and is fitted into the other blade of greater width, and they are movably connected in the middle by means of a spring piece and a third pivotal axle; the front ends of the lower blade and the upper blade each is disposed with a sharp cutting edge, the sharp cutting edges are connected to open and close by means of the spring piece; the two sides of the upper press lever each is disposed with one or more sets of protruding members; the two sides of the lower press lever each is disposed with a receiving member which is in position corresponding to the protruding members of the upper press lever, or the two sides of the upper press lever each is disposed with one or more receiving members, or the two sides of the lower press lever each is disposed with one set of receiving members which is in position corresponding to the protruding members of the upper press lever, and the protruding members and the corresponding receiving members are movably engaged.

The protruding member of the said nail clipper is a set of two protruding pieces, and there is a certain distance in between the two protruding pieces for the two protruding pieces to shift slightly when being compressed; the receiving member is a recess, the width of the receiving member is slightly shorter than the width of the two protruding pieces.

The upper press lever of the said nail clipper is movably connected with the rear end of the lower blade by means of the first pivotal axle and can be rotated at an angle of substantially 180 degree relative to the lower blade, and the lower press lever is movably connected with the rear end of the upper blade by means of the second pivotal axle and can be rotated at an angle of substantially 180 degree relative to the upper blade.

On the outside of the slender body of the said nail clipper as formed by the upper press lever and the lower press lever which are movably engaged, an upper cover and a lower cover are disposed and which are fitted onto the outer surfaces of the upper press lever and the lower press lever respectively to form a slender etui.

Any one of the contact surfaces of the upper press lever and the lower press lever of the said nail clipper with the upper cover and the lower cover is disposed with one or more recesses, and the upper cover and the lower cover each is disposed with one or more projections which are in position corresponding to the recesses, thereby securely engaging the upper press lever and the lower press lever with the upper cover and the lower cover.

Any one of the contact surfaces of the upper press lever and the lower press lever of the said nail clipper with the upper cover and the lower cover is disposed with one or more projections, and the upper cover and the lower cover each is disposed with one or more recesses which are in position corresponding to the projections, thereby securely engaging the upper press lever and the lower press lever with the upper cover and the lower cover.

The lengths of the upper cover and the lower cover of the said nail clipper are longer or slightly longer than the lengths of the upper press lever and the lower press lever, the widths of the upper cover and the lower cover are longer or slightly longer than the widths of the upper press lever and the lower press lever, the heights of the two sides of the upper cover and the lower cover are slightly higher than the heights of the two sides of the upper press lever and the lower press lever, thereby not impeding the folding of the upper press lever and the lower press lever.

The upper cover and the lower cover of the said nail clipper each is disposed with a hook-shaped projecting member in position where the upper cover is engaged with the first pivotal axle and where the lower cover is engaged with the second pivotal axle, thereby securely engaging the upper cover and the lower cover with the upper press lever and the lower press lever respectively.

The upper cover and the lower cover of the said nail clipper each can form one piece with the upper press lever and the lower press lever respectively.

The upper cover and the lower cover of the said nail clipper can be in the shape of a half oval, a rectangle, a half ellipse, a cartoon character, an animal, a traffic vehicle or a food product.

The ends not adjacent to the third pivotal axle of the upper cover or the lower cover of the said nail clipper is disposed with a ring onto which a key ring or a hanging ornament can be attached to facilitate its ease of carrying or to increase its aesthetic value.

The operating principles of the present invention are as follows:

When the present invention is stored, the upper press lever and the lower press lever are folded, the protruding members are inserted into the receiving members. As the widths of the receiving members are slightly shorter than the widths of the two protruding pieces, the two protruding pieces shift slightly inwards when being compressed, thereby attaining the interlocking effect, and therefore the lower blade and the upper blade come into abutting contact and are locked, and the cutting edges of the lower blade and the upper blade occlude, and the lower blade and the upper blade are entirely just fit for storage within the slender body. Since the upper cover and the lower cover are fitted onto the upper press lever and the lower press lever, when the upper press lever and the lower press lever are folded, the upper cover and the lower cover form a slender etui. It is convenient for storage and it can also completely protect the cutting edges, thereby preventing them from being exposed and holding dirt.

When the present invention is in use, the upper cover and the lower cover are first gently pulled open, as the upper cover and the lower cover are fitted onto the upper press lever and the lower press lever, the upper press lever and the lower press lever are therefore simultaneously pulled open, thereby causing the protruding members to be disengaged from the receiving members. The upper cover and the lower cover are then rotated along the pivotal axles relative to the lower blade and the upper blade until they are substantially horizontally disposed, the lower blade and the upper blade are then open, and the user is only required to compress the parts near the ends of the upper cover and the lower cover, it can bring the sharp cutting edges of the lower blade and the upper blade to occlude. By repeatedly compressing the parts near the ends of the upper cover and the lower cover, the cutting edges of the lower blade and the upper blade are movably open and close, thereby achieving the object of nail trimming.

After use, the upper cover and the lower cover are then folded, and the parts on the surfaces of the upper cover and the lower cover which are in position corresponding to the protruding members and the receiving members are pressed inwards by fingers, thereby inserting the protruding members into the receiving members along the wider opening portion, so as to lock the lower blade and the upper blade when they come into abutting contact and to store them within the slender body, and the nail clipper is folded into an etui.

By adopting the said technical proposals, the present invention provides a nail clipper which has the advantages of being safe and reliable, small in size, convenient for storage, and capable of reducing the production costs. The upper and lower press levers of the present invention can completely conceal the cutting edges, prevent the cutting edges from being exposed causing scratches on clothing articles and human bodies, and prevent dirt and the like from accumulating in between the cutting edges, thereby making the nail clipper more durable. As the etui for storing the cutting edges is simultaneously used as the press levers, the construction of the present invention can be simplified and fewer production materials are used, thereby reducing the production costs.

DETAILED DESCRIPTION OF THE INVENTION

The preferred embodiment of the present invention is further described in detail with the following embodiment and the accompanying drawings.

Figure 1:
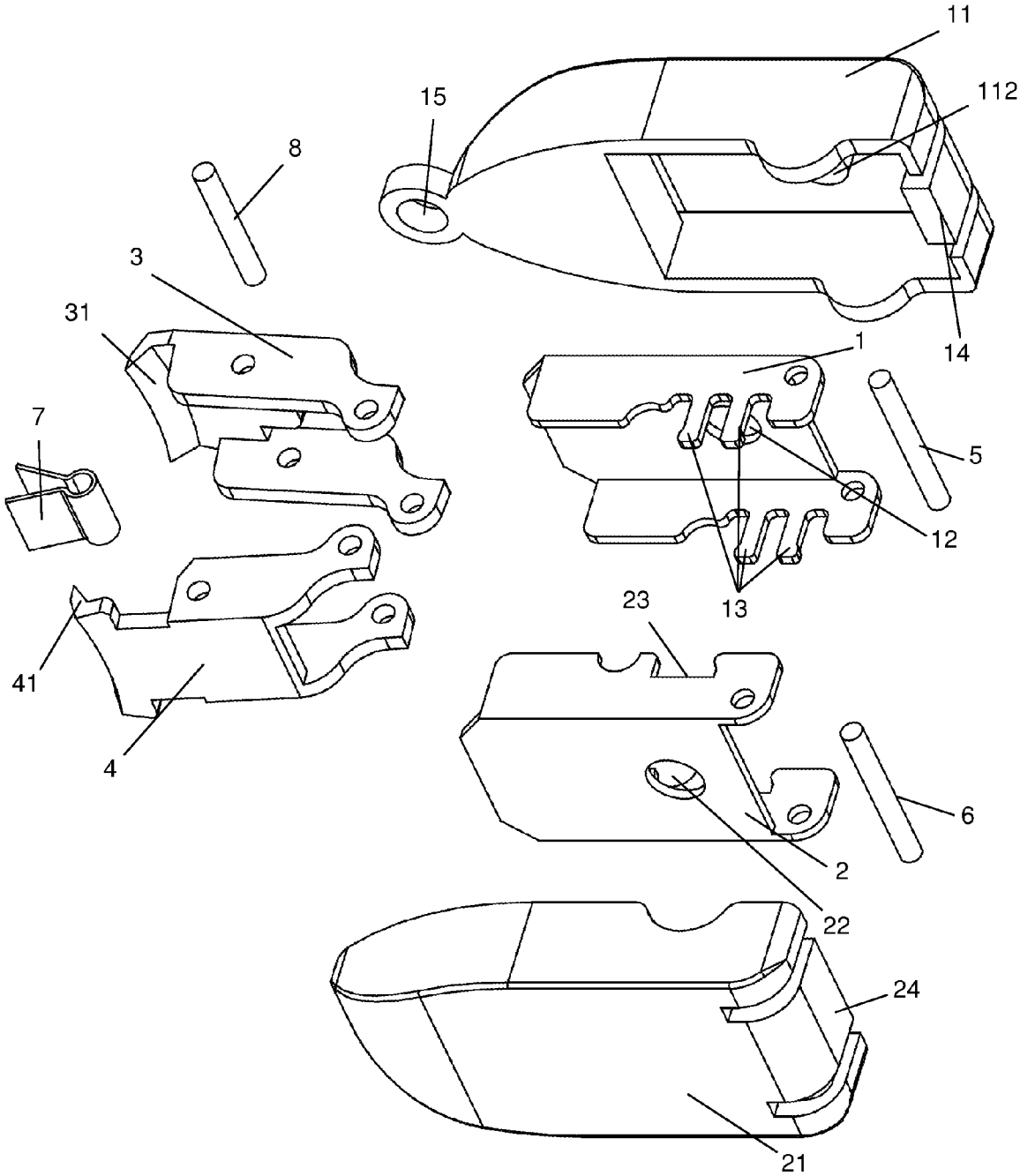
FIG. 1 is an exploded view of the present invention.
Figure 2:
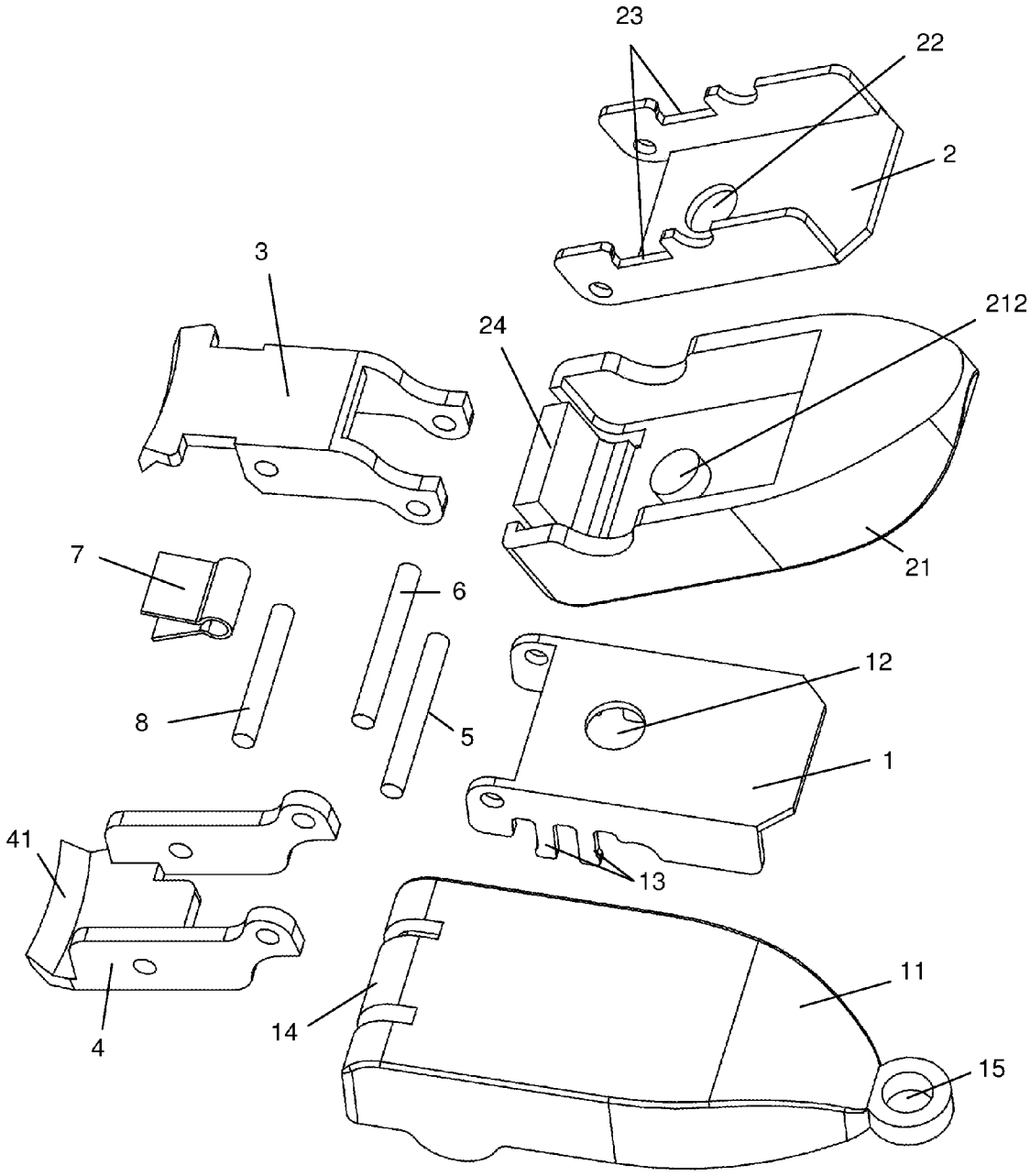
FIG. 2 is another exploded view of the parts as shown in FIG. 1.

As illustrated in FIGS. 1 and 2, a nail clipper comprising a slender body formed by an upper press lever 1 and a lower press lever 2 which are movably engaged, an upper cover 11 and a lower cover 21 which are fitted onto the outer surfaces of the upper press lever 1 and the lower press lever 2 respectively to form a slender etui. In the present embodiment, the lengths of the upper cover 11 and the lower cover 21 are slightly longer than the lengths of the upper press lever 1 and the lower press lever 2, the widths of the upper cover 11 and the lower cover 21 are slightly longer than the widths of the upper press lever 1 and the lower press lever 2, the heights of the two sides of the upper cover 11 and the lower cover 21 are slightly higher than the heights of the two sides of the upper press lever 1 and the lower press lever 2, thereby not impeding the folding of the upper press lever 1 and the lower press lever 2; in the present embodiment, the upper cover 11 and the lower cover 21 are in the shape of a half oval, in other embodiments, the upper cover 11 and the lower cover 21 can be in the shape of a rectangle, a half ellipse, a cartoon character, an animal, a traffic vehicle or a food product; in the present embodiment, each of the contact surfaces of the upper press lever 1 and the lower press lever 2 with the upper cover 11 and the lower cover 21 is disposed with one projection 112, 212, and the upper cover 11 and the lower cover 21 each is disposed with one recess 12, 22 which are in position corresponding to the projections 112, 212, thereby securely engaging the upper press lever 1 and the lower press lever 2 with the upper cover 11 and the lower cover 21; in other embodiments, there may be more than one projection 112, 212 and more than one recess 12, 22; or the positions of the projections 112, 212 and the recess 12, 22 can be swapped; in other embodiments, each of the contact surfaces of the upper press lever 1 and the lower press lever 2 with the upper cover 11 and the lower cover 21 is disposed with one projection and one recess, and the upper cover 11 and the lower cover 21 each is disposed with one recess and one projection which are in position corresponding to the projection and the recess; in yet other embodiments, the upper cover 11 and the lower cover 21 can be formed integrally with the upper press lever 1 and the lower press lever 2; the nail clipper of the present embodiment further comprises a lower blade 4 which is movably pivotally engaged with the upper press lever 1 by means of a first pivotal axle 5, and an upper blade 3 which is movably pivotally engaged with the lower press lever 2 by means of a second pivotal axle 6; the upper press lever 1 is movably connected with the rear end of the lower blade 4 by means of the first pivotal axle 5 and can be rotated at an angle of substantially 180 degree relative to the lower blade 4, and the lower press lever 2 is movably connected with the rear end of the upper blade 3 by means of the second pivotal axle 6 and can be rotated at an angle of substantially 180 degree relative to the upper blade 3; in the present embodiment, the upper cover 11 and the lower cover 12 each is disposed with a hook-shaped projecting member 14, 24 in position where the upper cover 11 is engaged with the first pivotal axle 5 and where the lower cover 21 is engaged with the second pivotal axle 6, thereby securely engaging the upper cover 11 and the lower cover 21 with the upper press lever 1 and the lower press lever 2 respectively; the widths of the lower blade 4 and the upper blade 3 are slightly lesser than the widths of the upper press lever 1 and the lower press lever 2, the lengths thereof are lesser than the lengths of the upper press lever 1 and the lower press lever 2; the slender body has a cavity for receiving the lower blade 4 and the upper blade 3; in the present embodiment, the upper blade 3 is of lesser width and is fitted into the lower blade 4 of greater width, and they are movably connected in the middle by means of a spring piece 7 and a third pivotal axle 8; the front ends of the lower blade 4 and the upper blade 3 each is disposed with a sharp cutting edge 31, 41, the sharp cutting edges 31, 41 are connected to open and close by means of the spring piece 7; the end not adjacent to the third pivotal axle 8 of the upper cover is disposed with a ring 15 onto which a key ring or a hanging ornament can be attached to facilitate its ease of carrying or to increase its aesthetic value.

Figure 6:
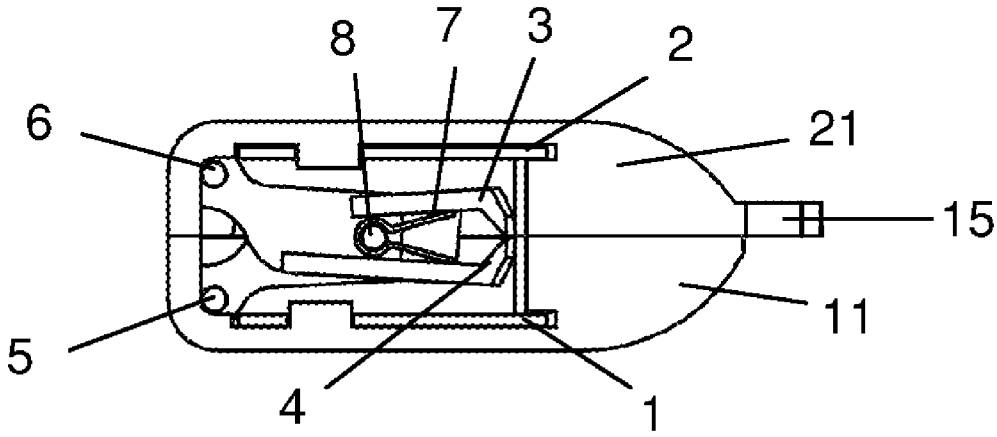
FIG. 6 is a sectional view of the prevent invention when being folded for storage.

As illustrated in FIGS. 1, 2 and 6, the two sides of the upper press lever 1 each is disposed with one set of protruding member 13; the protruding member 13 of is a set of two protruding pieces, and there is a certain distance in between the two protruding pieces for the two protruding pieces to shift slightly when the protruding member 13 is being compressed; the two sides of the lower press lever 2 each is disposed with a receiving member 23 which is in position corresponding to the protruding members 13 of the upper press lever 1, the receiving member 23 is a recess, the width of the receiving member 23 is slightly shorter than the width of the two protruding pieces so that the two can securely interlock with each other when the protruding member 13 is inserted into the receiving member 23; in other embodiments, the two sides of the upper press lever 1 each can be disposed with more than one set of protruding member 13, the two sides of the lower press lever 2 each can be disposed with more than one receiving member 23 which is in position corresponding to the protruding members 13 of the upper press lever 1; or the two sides of the lower press lever 2 each is disposed with one or more set of protruding members, and the two sides of the upper press lever 1 each is disposed with one or more than one receiving member each of which is in position corresponding to the protruding members of the lower press lever; or one side of the upper press lever 1 is disposed with one or more than one set of protruding member 13, and the other side is disposed with one or more than one receiving member, while one side of the lower press lever 2 is disposed with receiving members each of which is in position corresponding to the protruding members of the upper press lever 1, and the other side is disposed with protruding members each of which is in position corresponding to the receiving members of the upper press lever 1; or the two sides of the upper press lever 1 each is disposed with more than one set of protruding member 13 and more than one receiving member, and the two sides of the lower press lever 2 each is disposed with more than one receiving member 23 and more than one protruding member each of which is in position corresponding to the protruding members 13 and the receiving members of the upper press lever correspondingly.

Figure 5:
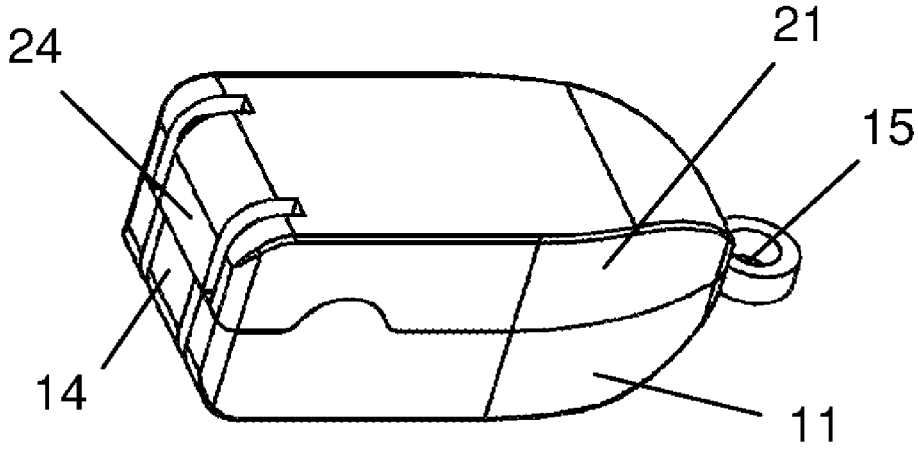
FIG. 5 is a perspective view of the present invention when being folded for storage.

The operating principles of the present invention are as follows:

As illustrated in FIGS. 5 and 6, when the present invention is stored, the upper press lever 1 and the lower press lever 2 are folded, the protruding members 13 are inserted into the receiving members 23. As the widths of the receiving members 23 are slightly shorter than the widths of the two protruding pieces, the two protruding pieces shift slightly inwards when being compressed, thereby attaining the interlocking effect, and therefore the lower blade 4 and the upper blade 3 abut and lock against each other, and the cutting edges 41, 31 of the lower blade 4 and the upper blade 3 abuts against each other, and the lower blade 4 and the upper blade 3 are entirely just fit for storage within the slender body. Since the upper cover 11 and the lower cover 21 are fitted onto the upper press lever 1 and the lower press lever 2, when the upper press lever 1 and the lower press lever 2 are folded, the upper cover 11 and the lower cover 21 form a slender etui. It is convenient for storage and it can also completely protect the cutting edges, thereby preventing them from being exposed and holding dirt.

Figure 3:
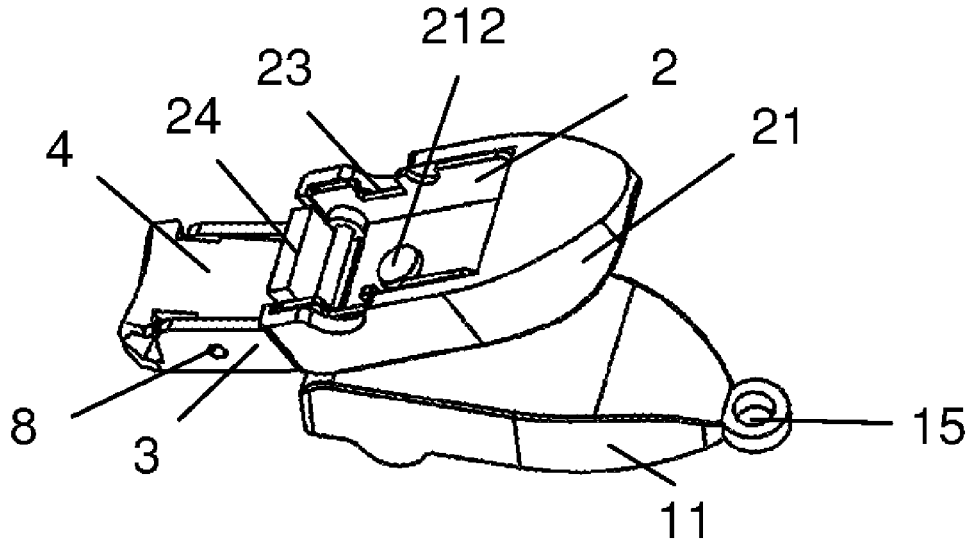
FIG. 3 is a perspective view of the present invention while in use.
Figure 4:
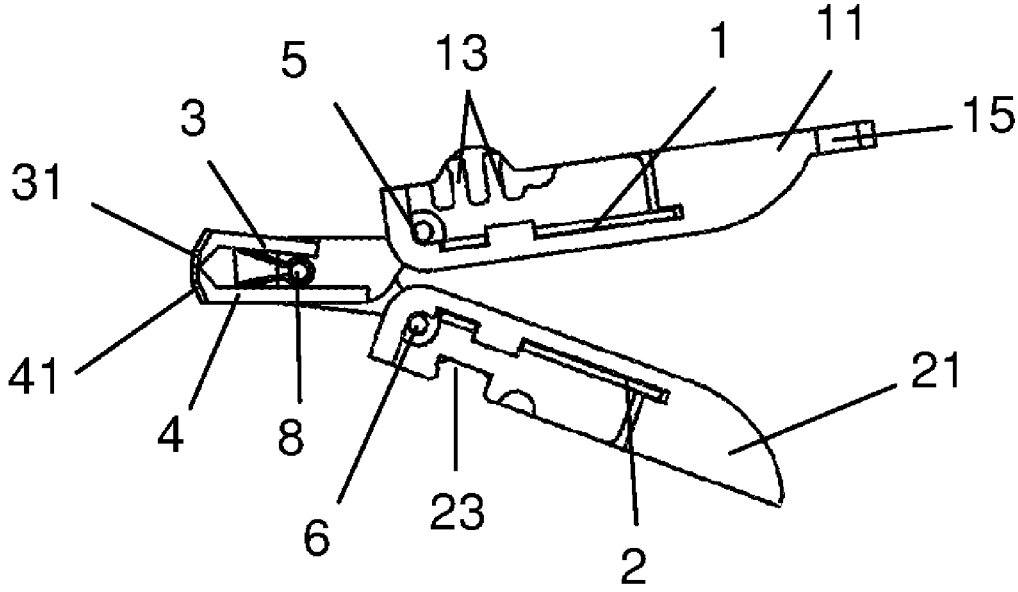
FIG. 4 is a sectional view of the present invention while in use.

As illustrated in FIGS. 3 and 4, when the present invention is in use, the upper cover 11 and the lower cover 21 are first gently pulled open, as the upper cover 11 and the lower cover 21 are fitted onto the upper press lever 1 and the lower press lever 2, the upper press lever 1 and the lower press lever 2 are therefore simultaneously pulled open, thereby causing the protruding members 13 to be disengaged from the receiving members 23. The upper cover 11 and the lower cover 21 are then rotated along the pivotal axles 5, 6 relative to the lower blade 4 and the upper blade 3 until they are substantially horizontally disposed, the lower blade 4 and the upper blade 3 are then open, and the user is only required to compress the parts near the ends of the upper cover 11 and the lower cover 21, it can bring the sharp cutting edges 41, 31 of the lower blade 4 and the upper blade 3 to occlude. By repeatedly compressing the parts near the ends of the upper cover 11 and the lower cover 21, the cutting edges 41, 31 of the lower blade 4 and the upper blade 3 are movably open and close, thereby achieving the object of nail trimming.

As illustrated in FIGS. 5 and 6, after use, the upper cover 11 and the lower cover 21 are then folded, and the parts on the surfaces of the upper cover 11 and the lower cover 21 which are in position corresponding to the protruding members 13 and the receiving members 23 are pressed inwards by fingers, thereby inserting the protruding members 13 into the receiving members 23 along the wider opening portion, so as to lock the lower blade 4 and the upper blade 3 when they come into abutting contact and to store them within the slender body, and the nail clipper is folded into an etui.

The above embodiment is the preferred embodiment of the present invention. The present invention is capable of other embodiments and is not limited to the above embodiment. Any other variation, decoration, substitution, combination or simplification, whether in substance or in principle, not deviated from the spirit of the present invention, is replacement or substitution of equivalent function and falls within the scope of protection of the present invention.

What is claimed is:

1. A nail clipper comprising:

a slender body formed by an upper press lever and a lower press lever which are movably engaged, a lower blade pivotally engaged with one end of the upper press lever by a first pivotal axle, and an upper blade pivotally engaged with one end of the lower press lever by a second pivotal axle;

the upper blade, lower blade, upper press lever, and lower press lever each have a width and a length, the upper blade has a width that is less than the width of the lower blade such that the upper blade fits within the lower blade, the width of the lower blade is less than the widths of both the upper press lever and the lower press lever, and the lengths of each of the upper blade and the lower blade are less than the lengths of each of the upper lever and the lower lever;

the slender body has a cavity for receiving the lower blade and the upper blade;

the upper blade and the lower blade are movably connected to each other at a mid point of each of the blades by a spring and a third pivotal axle;

the upper blade and the lower blade each have a front end, and each front end is disposed with a sharp cutting edge;

the upper press lever and the lower press lever each have two sidewalls;

the sidewalls of the upper press lever each have a protruding member disposed thereon; and the sidewalls of the lower press lever each have a receiving member, wherein each receiving member is in a position corresponding to one of the protruding members of the upper press lever such that each protruding member is movingly engageable with the corresponding receiving member.

2. A nail clipper as in claim 1, wherein each of the protruding members is comprised of a set of two protruding pieces, and there is a distance between the two protruding pieces allowing the protruding pieces to shift slightly when being compressed; and each of the receiving members is a recess, the width of each receiving member is slightly smaller than the width of the corresponding protruding member.

3. A nail clipper as in claim 1, wherein the upper press lever of the said nail clipper is movably connected with the rear end of the lower blade by means of the first pivotal axle and can be rotated at an angle of substantially 180 degree relative to the lower blade, and the lower press lever is movably connected with the rear end of the upper blade by means of the second pivotal axle and can be rotated at an angle of substantially 180 degree relative to the upper blade.

4. A nail clipper as in claim 1, wherein an upper cover is fitted onto an outer surface of the upper press lever and a lower cover is fitted onto an outer surface of the lower press lever to form a slender etui.

5. A nail clipper as in claim 4, wherein each of the respective outer surfaces of the upper press lever and the lower press lever has a recess formed therein, and each of the upper cover and lower cover have a projection extending from respective inner surfaces fitted onto the respective outer surfaces of the uppers press lever and the lower press lever; and each projection corresponds to and engages a respective recess to secure the upper press lever to the upper cover and the lower press lever to the lower cover.

6. A nail clipper as in claim 4, wherein the upper and lower cover each has a length, width and height, and the upper press lever and the lower press lever each have a height; wherein the lengths, widths, and heights of each of the upper and lower covers are slightly greater than the respective lengths, widths, and heights of each of the upper press lever and the lower press lever to prevent impeding of folding the upper and lower press levers.

7. A nail clipper as in claim 4, wherein the upper cover and the lower cover each is disposed with a hook-shaped projection member in respective locations where the upper press lever is engaged with the first pivotal axle and where the lower press lever is engaged with the second pivotal axle.

8. A nail clipper as in claim 4, wherein the upper cover and the upper press lever function as a single unit and the lower cover and the lower press lever function as a single unit.

9. A nail clipper as in claim 4, wherein the upper cover and the lower cover each is in the shape of a half oval.

* * * * *